US006467488B2

(12) United States Patent
Coleman

(10) Patent No.: US 6,467,488 B2
(45) Date of Patent: Oct. 22, 2002

(54) METHOD FOR CUTTING THE TIE-LEAF ON BUNDLED LEAF TOBACCO

(75) Inventor: G. A. John Coleman, Richmond, VA (US)

(73) Assignee: Universal Leaf Tobacco Company, Inc., Richmond, VA (US)

( * ) Notice: Subject to any disclaimer, the term of this patent is extended or adjusted under 35 U.S.C. 154(b) by 0 days.

(21) Appl. No.: 10/134,724

(22) Filed: Apr. 30, 2002

(65) Prior Publication Data

US 2002/0129825 A1 Sep. 19, 2002

Related U.S. Application Data

(62) Division of application No. 09/657,636, filed on Sep. 7, 2000.

(51) Int. Cl.[7] ..... A24B 5/08; B26D 3/00

(52) U.S. Cl. ..... 131/318; 131/322; 83/53; 83/56; 83/931

(58) Field of Search ..... 131/313, 318, 131/319, 322; 83/909, 931, 53, 56, 177, 1.11, 212

(56) References Cited

U.S. PATENT DOCUMENTS

| | | | | |
|---|---|---|---|---|
| 2,055,307 A | | 9/1936 | Priddy | |
| 3,252,249 A | | 5/1966 | Propst | |
| 3,526,162 A | | 9/1970 | Willcox | |
| 3,978,748 A | | 9/1976 | Leslie et al. | |
| 4,182,170 A | | 1/1980 | Grupp | |
| 4,580,580 A | * | 4/1986 | Kjaer et al. | 131/105 |
| 4,592,698 A | | 6/1986 | Semp et al. | |
| 4,640,300 A | | 2/1987 | Coleman | |
| 4,693,153 A | | 9/1987 | Wainwright et al. | |
| 5,243,886 A | | 9/1993 | Rudy et al. | |
| 5,664,585 A | | 9/1997 | Levy | |
| 5,759,086 A | | 6/1998 | Klingel | |
| 6,006,637 A | | 12/1999 | Sanders et al. | |

* cited by examiner

*Primary Examiner*—Christopher A. Fiorilla
*Assistant Examiner*—Carlos Lopez
(74) *Attorney, Agent, or Firm*—Pillsbury Winthrop LLP

(57) ABSTRACT

A method is provided for cutting tying elements of successive tobacco leaf bundles, wherein the butt ends of the leaves of each bundle are grouped and secured together by a transversely extending tying element disposed in surrounding relation to the grouped together butt ends. The method comprises moving successive bundles along a predetermined path past a cutting station with the grouped butt ends of successive bundles disposed transverse to the path within a predetermined transverse position within the path. A liquid jet configuration is established at the cutting station and moved through a repetitious path having a transverse extent greater than the transverse extent of the tying elements within the transverse position of the butt ends of the bundles. The moving jet configuration is directed onto the butt ends of successive bundles during the movement thereof along the predetermined path through the cutting station to transversely cut the tying elements thereof.

9 Claims, 6 Drawing Sheets

METHOD FOR CUTTING THE TIE-LEAF ON BUNDLED LEAF TOBACCO

The present application is a division of U.S. patent application Ser. No. 09/657,636, filed Sep. 7, 2000, the entirety of which is hereby incorporated into the present application by reference.

FIELD OF THE INVENTION

The present invention relates to tobacco leaf processing and more particularly to the cutting of the tie-leaf on bundled leaf tobacco.

BACKGROUND OF THE INVENTION

In certain tobacco-producing regions, farmers grade tobacco leaves and tie them in bundles, varying from 10 to 30 leaves each. A single leaf is wrapped around the butt end of the bundle and tucked in between the stems to secure the bundle. When these bundles are processed, they are laid across a conveying structure such that the bundles are 90° to the direction of travel of the conveying structure with the butt ends closest to the person placing them. Typically, the first operation is the cutting of the tips of the bundles to segregate them for a different process. A tipping board is used to line up the tips of the leaves as they are placed on the conveying structure and then they pass by a tip cutting mechanism, such as large intermeshing circular blades. Once this has happened, the remaining part of the bundle is passed by a mechanism for cutting the tie-leaf so the bundles can fall apart and the individual leaves can be further processed. If the bundles are not tipped, the butt ends are just lined up manually and then passed by the tie-leaf cutting mechanism. The tie-leaf must be cut or else the bundle remains intact and cannot be conditioned or threshed efficiently.

There are several known mechanisms for cutting the tie-leaf on bundled leaf tobacco. One known mechanism includes two counter-rotating rollers, one above the other. The top one is cantilevered and pre-loaded to supply a downward force, and is equipped with planar blades spaced apart and parallel to the axis of rotation. This creates a mangle effect, and the planar blades cut through the tie-leaf, allowing the bundle to fall apart. Another mechanism is disclosed in U.S. Pat. No. 5,664,585. The '585 patent discloses a rotating cylindrical cutting drum including arcuate cutting blades thereon to cut the tie-leaves.

These types of mechanisms have several deficiencies. Because of differing sizes of bundles, if the bundles are lined up for tipping, the butt ends may not be on line for the cutting mechanism. When a large bundle enters the cutting mechanism next to a small bundle, the blades may not act upon the small bundle. The action of the rollers/drum and blades under pressure damages the leaves in the bundle, causing the generation of dust and undesirable small particles. This is particularly bad where the tobacco is low in moisture. Bundles also cause the equipment to choke-up and frequent stoppages occur, costing expensive downtime. Because of the sharp blades, operators must take great care when unstopping them.

There is a need for a method and apparatus for cutting tie-leaves that has a cutting efficiency close to 100% and causes no trauma to the tobacco. There is also a need for a method and apparatus that does not obstruct the flow of tobacco, thus causing no stoppages.

It is known that a high-pressure liquid jet can cut a single tobacco leaf passed therethrough. However, this knowledge exists in areas quite unrelated to the present subject matter.

For example, U.S. Pat. No. 4,640,300 to Coleman discloses a tobacco stripping system for cutting successive individual tobacco leaves into strips by employing a set of three stationary liquid jet nozzles spaced apart by a predetermined distance related to the desired strip width. A conveying structure transports the leaves longitudinally through the streams of high-pressure liquid generated by the nozzles to provide three longitudinal cuts to strip the tobacco.

Applicant has found that it would be desirable to use high-pressure liquid jets to cut the tie-leaf on bundled leaf tobacco. However, a stationary jet arrangement of the '300 patent would not be suitable for purposes of the present subject matter. A transverse cut within the butt end area is needed to cut the tie-leaf, which cannot be done effectively by the conveyor and a stationary jet arrangement of the '300 patent.

The present invention is based upon the underlying concept that the disadvantages of the presently practiced procedures for cutting tie-leaves can be obviated by the use of a liquid jet to cut the tie leaves and more specifically to the creation of a workable method and apparatus combination for implementing the underlying concept.

SUMMARY OF THE INVENTION

It is an object of the present invention to provide the concept implementation described above. In accordance with the principles of the present invention, this objective is achieved by providing a method for cutting tying elements of successive tobacco leaf bundles, wherein the butt ends of the leaves of each bundle are grouped and secured together by a transversely extending tying element disposed in surrounding relation to the grouped together butt ends. The method comprises moving successive bundles along a predetermined path past a cutting station with the grouped butt ends of successive bundles disposed transverse to the path within a predetermined transverse position within the path. A liquid jet configuration is established at the cutting station and moved through a repetitious path having a transverse extent greater than the transverse extent of the tying elements within the transverse position of the butt ends of the bundles. The moving jet configuration is directed onto the butt ends of successive bundles during the movement thereof along the predetermined path through the cutting station to transversely cut the tying elements thereof.

In accordance with another aspect of the invention, there is provided an apparatus for cutting tying elements of successive tobacco leaf bundles, wherein the butt ends of the leaves of each bundle are grouped and secured together by a transversely extending tying element disposed in surrounding relation to the grouped together butt ends. The apparatus comprises a bundle moving structure constructed and arranged to move successive bundles along a predetermined path past a cutting station with the grouped butt ends of successive bundles disposed transverse to the path within a predetermined transverse position within the path. A jet providing structure directs a source of liquid under pressure into a liquid jet configuration. A mounting structure is constructed and arranged to mount the jet providing structure on a frame for movement through a repetitious path having a transverse extent greater than the transverse extent of the tying elements within the transverse position of the butt ends of the bundles. A power operated moving mechanism has structure constructed and arranged to move the jet providing structure through the repetitious path so that the liquid jet configuration is directed onto the butt ends of successive bundles during the movement thereof along the predetermined path through the cutting station to transversely cut the tying elements thereof.

These and other objects, features, and advantages of this invention will become apparent from the following detailed description when taken into conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF THE INVENTION

Figure 1A:
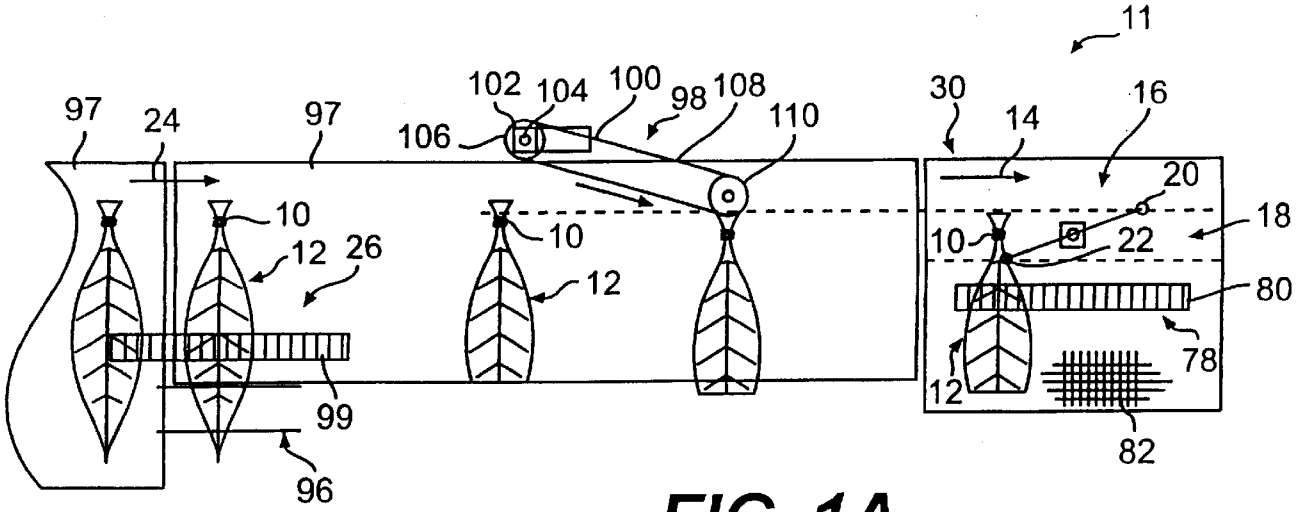
FIG. 1A is a top plan view of a method and apparatus for cutting tying elements of successive tobacco leaf bundles constructed in accordance with the principles of the present invention.
Figure 1B:
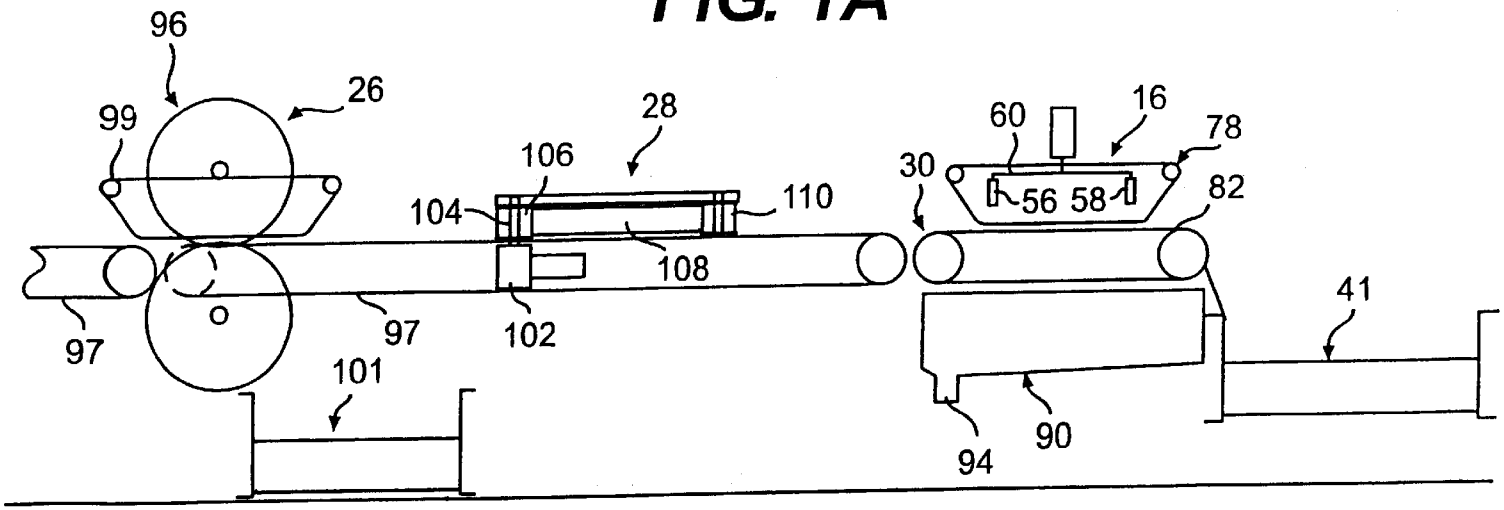
FIG. 1B is a side view of FIG. 1A.
Figure 2:
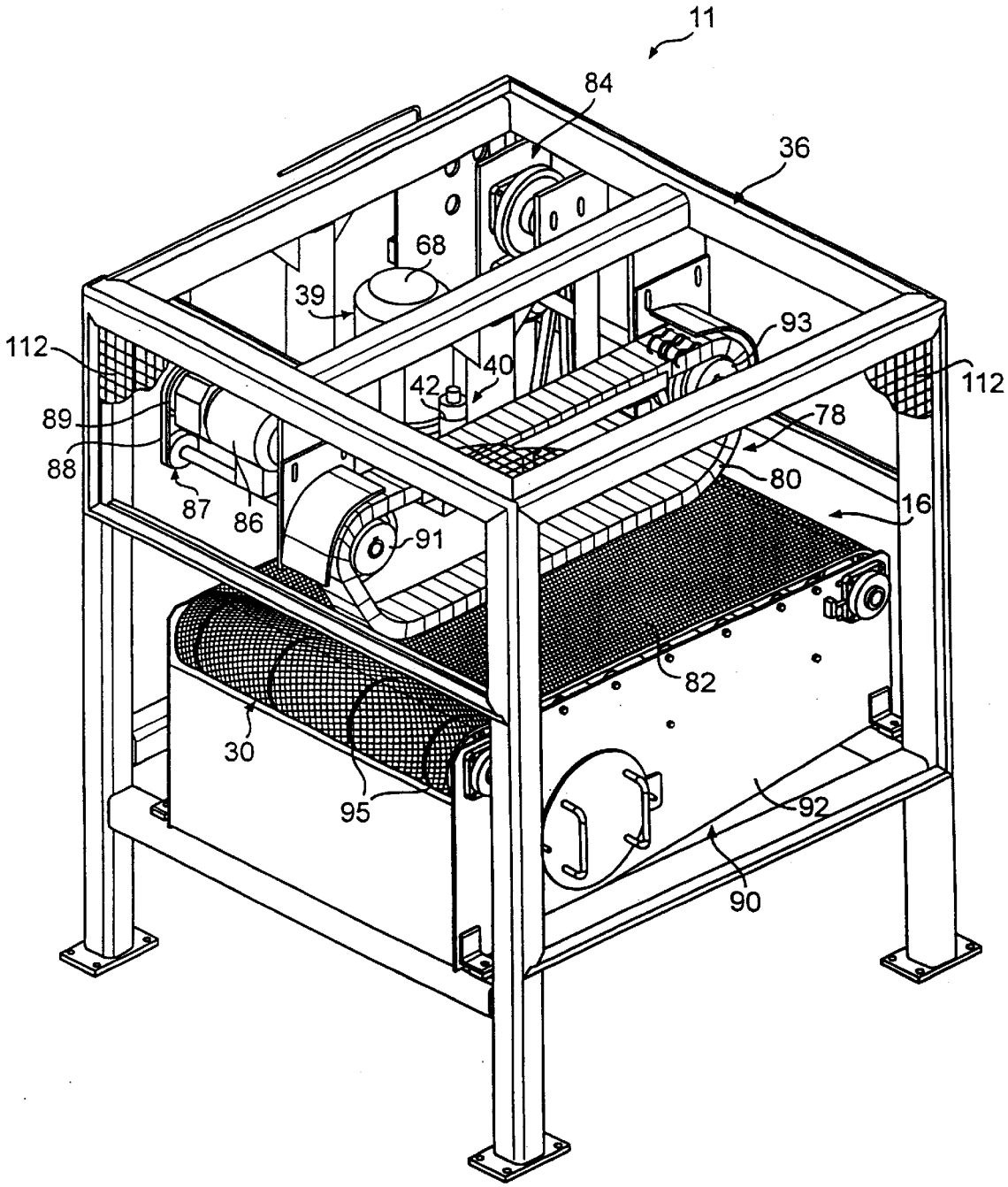
FIG. 2 is a perspective view of an apparatus for cutting tying elements of successive tobacco leaf bundles constructed in accordance with the principles of the present invention.

FIGS. 1A and 1B show a method for cutting tying elements 10 of successive tobacco leaf bundles, generally shown at 12, wherein the butt ends of the leaves of each bundle 12 are grouped and secured together by the transversely extending tying element 10 disposed in surrounding relation to the grouped together butt ends, which method embodies the principles of the present invention.

The method comprises moving successive bundles 12 along a predetermined path 14 past a cutting station, generally shown at 16, with the grouped butt ends of successive bundles 12 disposed transverse to the path within a predetermined transverse position within the path 14. A liquid jet configuration is established at the cutting station 16 and moved through a repetitious path having a transverse extent, shown generally at 18 between the dashed lines, greater than the transverse extent of the tying elements 10 within the transverse position of the butt ends of the bundles 12. The moving jet configuration is directed onto the butt ends of successive bundles 12 during the movement thereof along the predetermined path 14 through the cutting station 16 to transversely cut the tying elements 10 thereof.

The liquid jet configuration is continuous and includes two single jets 20, 22 spaced apart generally in the direction of movement along the predetermined path 14. The liquid jet configuration is defined by pressurized liquid at a pressure of the order of 50,000-psi being passed through an orifice having a diameter in the range of 0.008 to 0.010 inches.

As cutting is most efficient if the bundles 12 cannot be deflected under the liquid jet configuration, the method may include holding successive bundles 12 as successive bundles 12 are moved past the cutting station 16. The method may also include collecting the liquid used in cutting the tying elements 10.

So as to provide cuts of the tying elements 10 in the range of +e,fra 2+ee 41 to ¾" apart from one another, a repetitious path length is established and the speed of movement of the jet configuration is controlled with respect to the moving bundles 12. An average bundle will receive two cuts at this range and a larger than average bundle may sometimes receive three cuts. In order to provide a reasonable cutting speed, the transverse extent 18 of the repetitious path is no greater than 6 inches and the speed of movement along the predetermined path 14 is no greater than 100 FPM.

After successive bundles 12 move past the cutting station 16, the separated leaves of each bundle 12 may be moved along a different path that leads to further leaf processing stations, such as conditioning or threshing stations.

It is contemplated that successive bundles 12 having aligned tip ends are moved along a preceding continuous path 24 that leads to the predetermined path 14. The aligned tip ends of successive bundles 12 are removed as successive bundles 12 are moved along the preceding path 24 past a tip removing station, generally shown at 26. The butt ends of successive bundles 12 are then aligned as successive bundles 12 are moved along the preceding path 24 past an aligning station, generally shown at 28, between the tip removing station 26 and the cutting station 16.

The removed tip ends of successive bundles 12 may be collected and moved along a different path that leads to further tip end processing stations.

The invention also encompasses an apparatus, generally shown at 11, for cutting tying elements 10 of successive tobacco leaf bundles 12. Referring to FIGS. 1 to 6, the apparatus 11 comprises a bundle moving structure, generally shown at 30, constructed and arranged to move successive bundles 12 along the predetermined path 14 past the cutting station 16 with the grouped butt ends of successive bundles 12 disposed transverse to the path 14 within the predetermined transverse position within the path 14. A jet providing structure, generally shown at 32, is included for directing a source of liquid under pressure into a liquid jet configuration. A mounting structure, generally shown at 34, is constructed and arranged to mount the jet providing structure 32 on a frame, generally shown at 36, for movement through the repetitious path having the transverse extent 18 greater than the transverse extent of the tying elements 10 within the transverse position of the butt ends of the bundles 12. The repetitious path is an arcuate oscillatory path, shown in FIG. 5 at 38. A power operated moving mechanism, generally shown at 39, has structure constructed and arranged to move the jet providing structure 32 through the repetitious path so that the liquid jet configuration is directed onto the butt ends of successive bundles 12 during the movement thereof along the predetermined path 14 through the cutting station 16 to transversely cut the tying elements 10 thereof.

Figure 3:
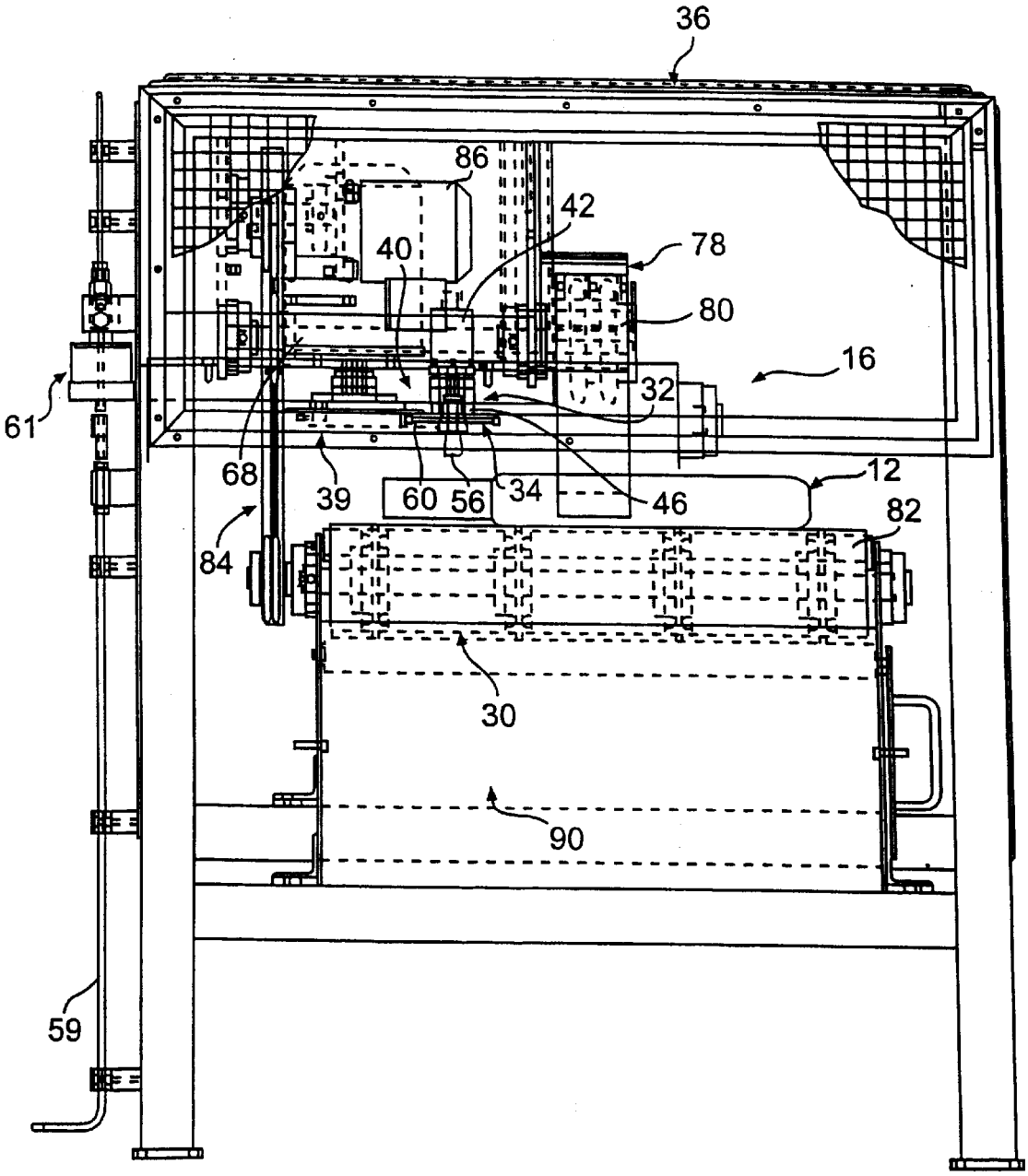
FIG. 3 is a front view of FIG. 2.
Figure 4:
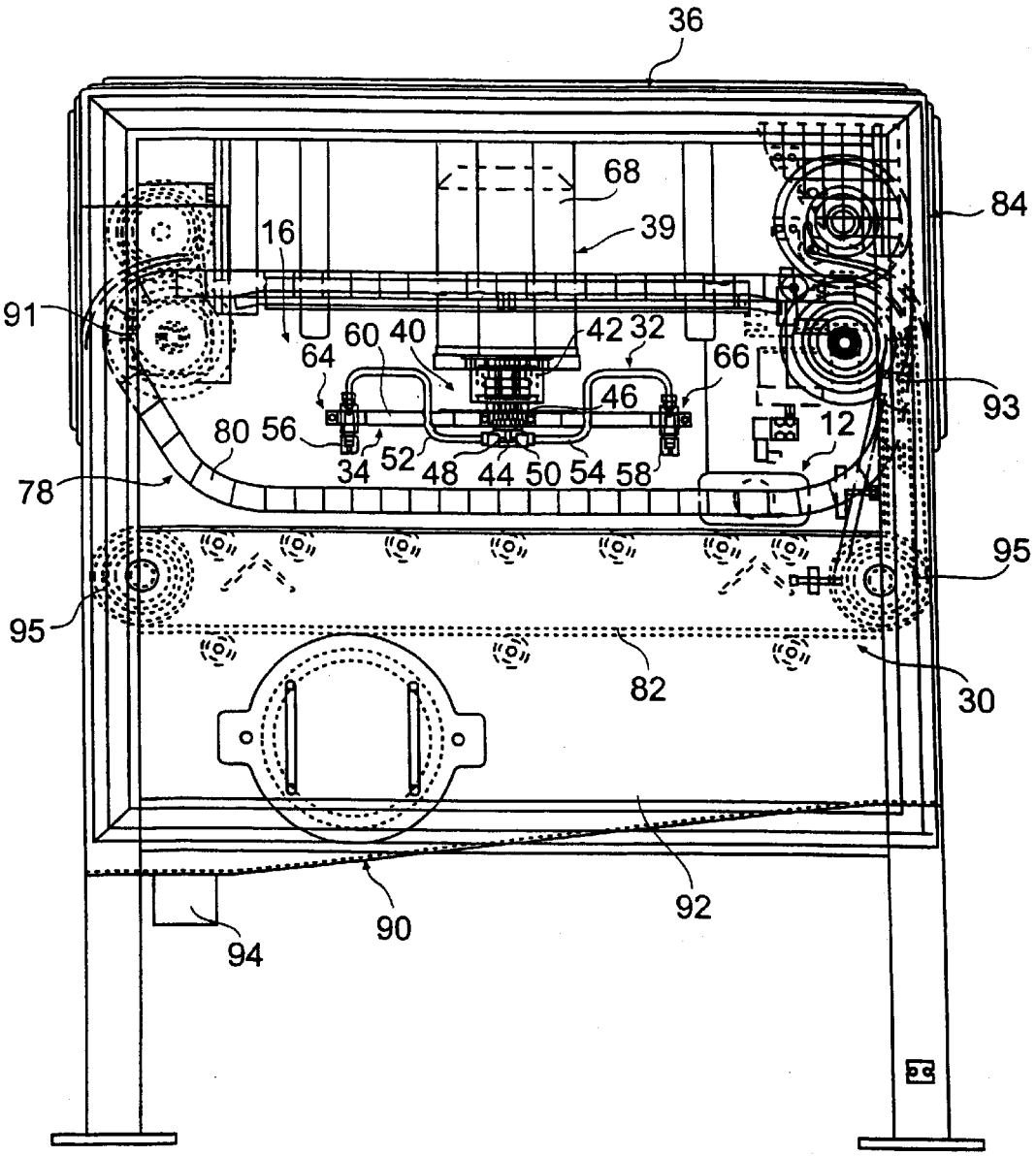
FIG. 4 is a side view of FIG. 2.
Figure 5:
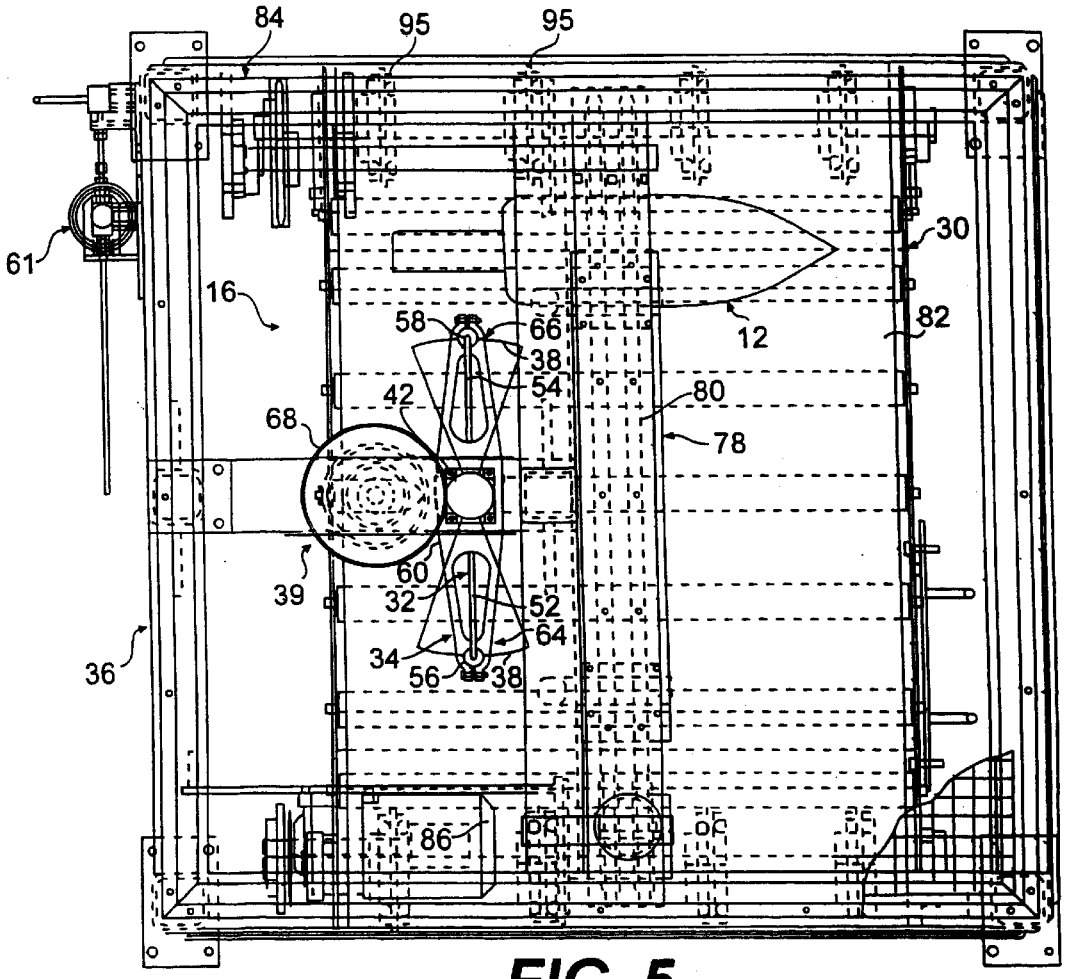
FIG. 5 is a top view of FIG. 2.
Figure 6:
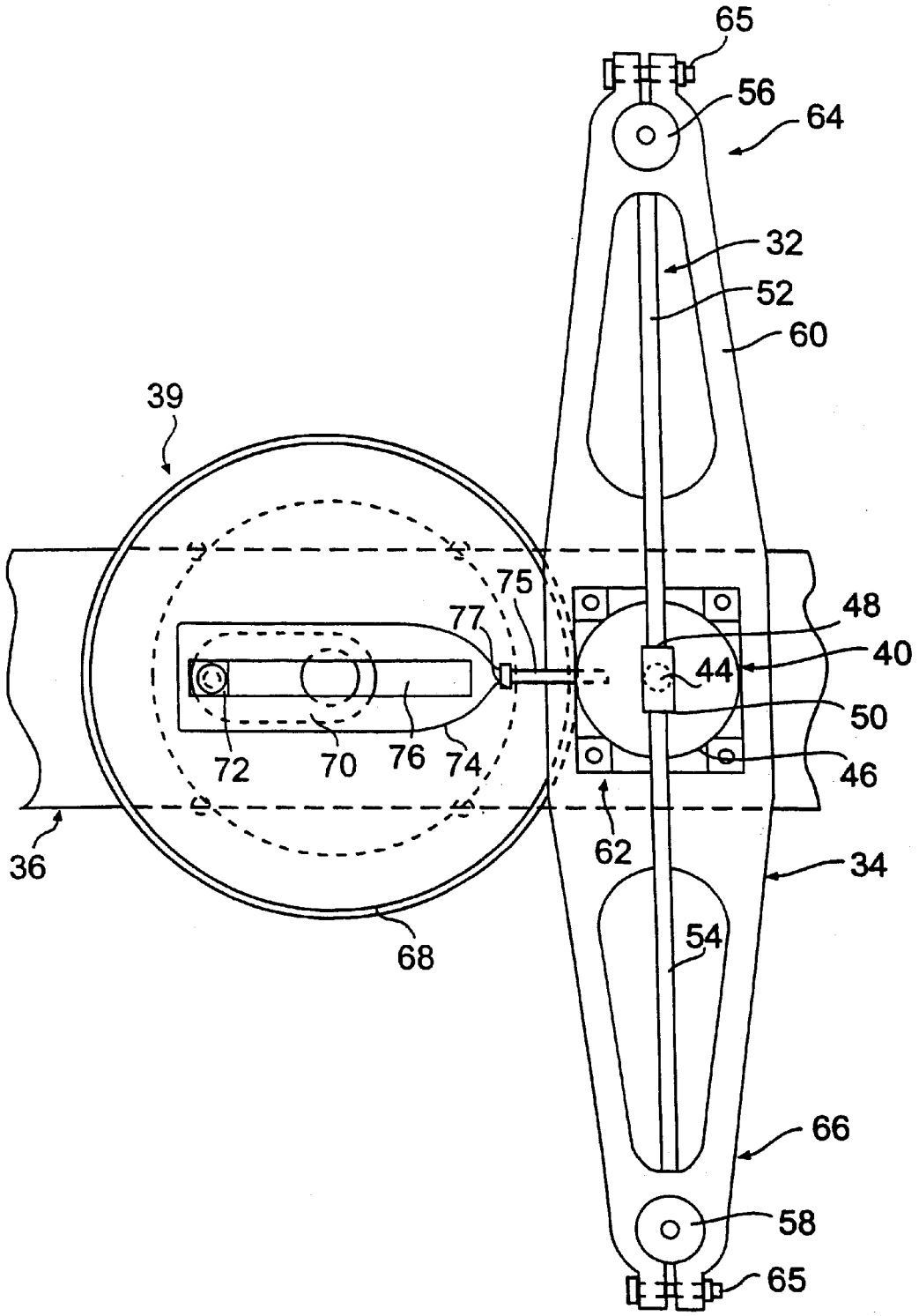
FIG. 6 is a bottom sectional view of FIG. 2 showing a jet providing structure, a mounting structure, and a power operated moving mechanism constructed in accordance with the principles of the present invention.

A single bundle 12 is shown in FIGS. 3–5 to show the general positioning of a bundle with respect to the cutting station 16, so spacing of successive bundles is not indicated.

After successive bundles 12 move past the cutting station 16, the separated leaves of each bundle 12 may be moved along a different path by a leave moving structure, generally shown at 41, that leads to further leaf processing stations, such as conditioning or threshing stations.

The jet providing structure 32 includes a liquid handling device, generally indicated at 40. The liquid handling device 40 may assume any desired construction which achieves the desired functions. However, a preferred construction is a high pressure swivel, an exemplary embodiment of which is the high pressure swivel made by Flow International Corporation under the designation part #008344-1. The swivel 40 includes a stationary housing member 42 having an inlet 44 and a pivotal member 46 having a pair of outlets 48, 50. A pair of conduits 52, 54 communicates the liquid under pressure in the pair of outlets 48, 50 to a pair of nozzles 56, 58 spaced apart generally in the direction of movement along the predetermined path 14. The tips of the nozzles 56, 58 are about 3 to 4 inches above the upper surface of the moving structure 30. The largest bundle 12 is about 2 inches in thickness, so there will be adequate clearance for successive bundles 12 to pass under the nozzles 56, 58.

The pressurized liquid is directed through high-pressure tubing 59 from an external pump unit (not shown) and then through a high-pressure control panel, generally shown at 61, before the pressurized liquid is directed to the handling device 40.

The mounting structure 34 includes structure fixing the stationary member 42 on the frame 36 with the pivotal axis of the pivotal member 46 extending vertically. An elongated member 60 has a central portion, generally shown at 62, fixed to the pivotal member 46 and opposing end portions, generally shown at 64, 66. The elongated member 60 also has structure fixing the nozzles 56, 58 to the end portions 64, 66 of the elongated member 60. The end portions 64, 66 clamp the nozzles 56, 58 and a fastener 65, such as a bolt or screw, secures the clamp.

The power operated moving mechanism 39 includes a variable speed motor 68 fixed to the frame 36 having a rotating output crank 70. A crank piece 72 is pivoted to the crank. A radially extending arm 74 is fixed with respect to the elongated member 60 to move therewith. It is shown that a connecting rod 75 is fixed at one end to the arm 74 and is fixed at the other end to the pivotal member 46. An adjustment fastener 77 may be used to adjust the length of the rod 75. The arm 74 has a radially extending slot 76 therein that slidably receives the crank piece 72 so that the operation of the motor 68 moves the nozzles 56, 58 on the end portions 64, 66 of the elongated member 60 through mirror image arcuate oscillatory paths 38.

The apparatus 11 includes a holding mechanism, generally shown at 78, at the cutting station 16 cooperating with the moving structure 30 therein having structure constructed and arranged to hold successive bundles 12 as successive bundles 12 are moved past the cutting station 16. The holding mechanism 78 includes an endless chain conveyor 80 having an operative flight with a linear velocity synchronized with the moving structure 30. The chain conveyor 80 rides on top of successive bundles 12, sandwiching successive bundles 12 between itself and the moving structure 30, outside the repetitious path of the liquid jet configuration so the bundles 12 cannot be deflected.

The moving structure 30 comprises an endless metallic mesh conveyor 82 having an operative flight extending generally horizontally to move successive bundles 12 past the cutting station 16. A metallic mesh is required as a belt-type conveyor would be severely damaged by the action of the liquid jet configuration.

The holding mechanism 78 and the metallic mesh conveyor 82 include a motion transmitting structure, generally shown at 84, therebetween and a motor 86 driving one of the mechanism 78 and conveyor 82. It is shown that a pulley, generally shown at 87, fixed to a rotary member 91 of the holding mechanism 78 is connected by belt 88 to the motor 86 which includes an output shaft having a pulley 89 to drive the holding mechanism 78. The motion transmitting structure 84 is driven by the opposite rotary member 93 of the holding mechanism 78 to drive sprocket wheels 95 to operate the metallic mesh conveyor 82.

When operating, some of the liquid is absorbed by the tobacco and some of the liquid is dissipated in the form of a mist. The mist aids in the conditioning of the tobacco leaves. When no bundles 12 are under the jets, water passes through the metallic mesh conveyor 82 and is collected in a collecting structure, generally shown at 90, that has interconnected walls 92 disposed below the operative flight of the metallic mesh conveyor 82 to collect the liquid used in cutting the tying elements 10. The structure 90 is also equipped with a drain 94.

It is contemplated that the moving structure 30 is constructed and arranged to move successive bundles 12 along the preceding continuous path 24 that leads to the predetermined path 14 past a tip removing mechanism, generally shown at 96, at the tip removing station 26 along the preceding path 24. Endless belt conveyors 97 may be used to move the bundles along the preceding path 24. The belt conveyors 97 include a motor driven pulley and an idler pulley interconnected by an endless belt. The tip removing mechanism 96 has structure constructed and arranged to remove aligned tip ends of the leaves of each bundle 12 as successive bundles 12 are moved along the preceding path 24 past the tip removing station 26. FIGS. 1A and 1B show large intermeshing blades being used to remove the tip ends, although the jets in U.S. Pat. No. 4,640,300 to Coleman as described in the background may be used. A holding mechanism 99, similar to the one described above, may also be used to hold successive bundles 12 as successive bundles 12 are moved past the tip removing station 26.

The removed tip ends of successive bundles 12 may be collected and moved along a different path by a tip moving structure, generally shown at 101, that leads to further tip end processing stations.

An aligning mechanism, generally shown at 98, at the aligning station 28 along the preceding path 24, between the tip removing station 26 and the cutting station 16, has structure constructed and arranged to align the butt ends of successive bundles 12 as successive bundles 12 are moved along the preceding path 24 past the aligning station 28.

The aligning mechanism 98 includes an endless belt alignment conveyor 100 having an operative flight disposed transversely vertical and at an angle to the preceding path 24. The angle established is about 30° to the preceding path 24. The alignment conveyor 100 includes a motor 102, fixed to a side structural portion of the belt conveyor 97, that has a rotating output shaft 104 and a drive pulley 106 that is interconnected by an endless belt 108 to an idler pulley 110.

The frame 36 shown includes four elongated upright support members with several cross-members for structural support and for mounting the various components of the apparatus. It is contemplated that different frame constructions may be utilized that will provide the structural support and mounting options necessary for an operational apparatus 11.

A debris safety screen 112 may be attached to the frame 36 surrounding the cutting station 16 to protect the users.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. A method for cutting tying elements of successive tobacco leaf bundles, wherein the butt ends of the leaves of each bundle are grouped and secured together by a transversely extending tying element disposed in surrounding relation to the grouped together butt ends, said method comprising:

moving successive bundles along a predetermined path past a cutting station with the grouped butt ends of successive bundles disposed transverse to the path within a predetermined transverse position within the path;

establishing a liquid jet configuration at said cutting station;

moving said jet configuration through a repetitious path having a transverse extent greater than the transverse extent of said tying elements within the transverse position of the butt ends of said bundles; and directing the moving jet configuration onto the butt ends of successive bundles during the movement thereof along said predetermined path through said cutting station to transversely cut the tying elements thereof.

2. A method according to claim 1 wherein the method includes:

moving successive bundles having aligned tip ends along a preceding continuous path that leads to said predetermined path;

removing the aligned tip ends of successive bundles as successive bundles are moved along said preceding path past a tip removing station;

aligning the butt ends of successive bundles as successive bundles are moved along said preceding path past an aligning station between said tip removing station and said cutting station.

3. A method according to claim 1 wherein the method includes holding successive bundles as successive bundles are moved past said cutting station.

4. A method according to claim 1 wherein the method includes collecting the liquid used in cutting the tying elements.

5. A method according to claim 1 wherein the method includes establishing a repetitious path length and controlling the speed of movement of said jet configuration with respect to the moving bundles so as to provide cuts in the range of ½" to ¾" apart.

6. A method according to claim 1 wherein said liquid jet configuration is continuous and includes two single jets spaced apart generally in the direction of movement along said predetermined path.

7. A method according to claim 1 wherein said liquid jet configuration is defined by pressurized liquid at a pressure of the order of 50,000 psi being passed through an orifice having a diameter in the range of 0.008 to 0.010 inches.

8. A method according to claim 1 wherein said transverse extent of said repetitious path is no greater than 6 inches so as to provide a reasonable cutting speed.

9. A method according to claim 1 wherein the speed of movement along said predetermined path is no greater than 100 FPM.

* * * * *